United States Patent [19]

Lambke

[11] Patent Number: 4,950,006

[45] Date of Patent: Aug. 21, 1990

[54] LATCH ASSEMBLY FOR A PIVOTAL CLOSURE MEMBER AND IMPROVED LATCH STRIKER MEANS THEREFOR

[75] Inventor: Bernard J. Lambke, Lake Villa, Ill.

[73] Assignee: Komatsu Dresser Company, Libertyville, Ill.

[21] Appl. No.: 309,604

[22] Filed: Feb. 10, 1989

[51] Int. Cl.[5] ..... E05C 3/26

[52] U.S. Cl. ..... 292/216; 292/341.17

[58] Field of Search ..... 292/216, 341.17, 340, 292/218

[56] References Cited

U.S. PATENT DOCUMENTS

| | | | |
|---|---|---|---|
| 1,789,073 | 1/1931 | Hogrefe . | |
| 2,030,677 | 2/1936 | Avels | 292/218 X |
| 2,643,906 | 6/1953 | Way | 292/341.17 |
| 2,937,044 | 5/1960 | Petitpas | 292/216 X |
| 3,224,802 | 12/1965 | Pelcin | 292/341.17 X |
| 3,228,676 | 1/1966 | Wittenberg | 268/72 |
| 3,747,273 | 7/1973 | Johnson | 49/394 |
| 4,035,016 | 7/1977 | Ricca | 296/28 C |
| 4,074,788 | 2/1978 | Joubert | 292/218 X |
| 4,174,129 | 11/1979 | Schwandt et al. | 292/216 |
| 4,835,997 | 6/1989 | Akright | 292/216 X |

*Primary Examiner*—Richard E. Moore

*Attorney, Agent, or Firm*—Edward G. Fiorito; William R. Peoples; Roy L. Van Winkle

[57] ABSTRACT

An improved latch assembly for securely latching a closure member in a position covering or uncovering an opening extending through a bulkhead of a vehicle cab or the like. The assembly includes pivotally locating a second striker pin on the bulkhead of the vehicle in such a position that it is cammed into latching engagement with the latch used for retaining the closure member in the covered position.

9 Claims, 4 Drawing Sheets

LATCH ASSEMBLY FOR A PIVOTAL CLOSURE MEMBER AND IMPROVED LATCH STRIKER MEANS THEREFOR

BACKGROUND OF THE INVENTION

This invention relates generally to improved latch assemblies for releaseably securing pivotal closure members. More particularly, but not by way of limitation, this invention relates generally to improved latch assemblies that releasably retain a pivotal closure member such as a window or the like in positions covering and uncovering an opening extending through a bulkhead such as window opening in a bulldozer or the like.

Earth moving and construction equipment such as bulldozers, front end loaders, maintainers, etc. are frequently provided with enclosed cabs for the operator. Even with the advent of air conditioning for such vehicles, they are still provided with openings that extend into the cab for the purpose of providing light, access or ventilation. Usually such openings are covered by windows, ventilation hatches, doors and the like. Even though the cabs are provided with air conditioning, it is frequently necessary or desirable to leave the windows, access hatches, doors or the like open providing natural ventilation into the cab.

On such heavy duty equipment, the closure members, that is the doors, windows, and hatches, are generally of very heavy construction. To leave such members free to pivot about their hinges during movement of the vehicle, could result in damage to the closure member, to the vehicle, or to a person working in the vicinity of the vehicle. Accordingly, it is highly desirable to provide such vehicles with latches that securely retain the closure member in a position covering the opening and further to provide latches that securely retain the closure members in a position wherein the openings are uncovered.

SUMMARY OF THE INVENTION

This invention relates generally to a latch assembly for releasably retaining a pivotal closure member, such as a window or the like in positions covering and uncovering an opening extending through a bulkhead. The latch assembly comprises a jaw-type latch mounted in the closure member, latch releasing means mounted in the closure member and accessible from one side thereof for releasing the latch, a striker member mounted on the bulkhead for latchably engaging the latch when the closure member is in the covered position, and striker means mounted on the bulkhead remote from the opening for latchably engaging the latch when the closure member is in the uncovered position.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein:

FIG. 1 is a fragmentary elevation view of a typical cab for a bulldozer or the like.

DETAILED DESCRIPTION OF THE PREFERRED EMBODIMENT

Figure 1:
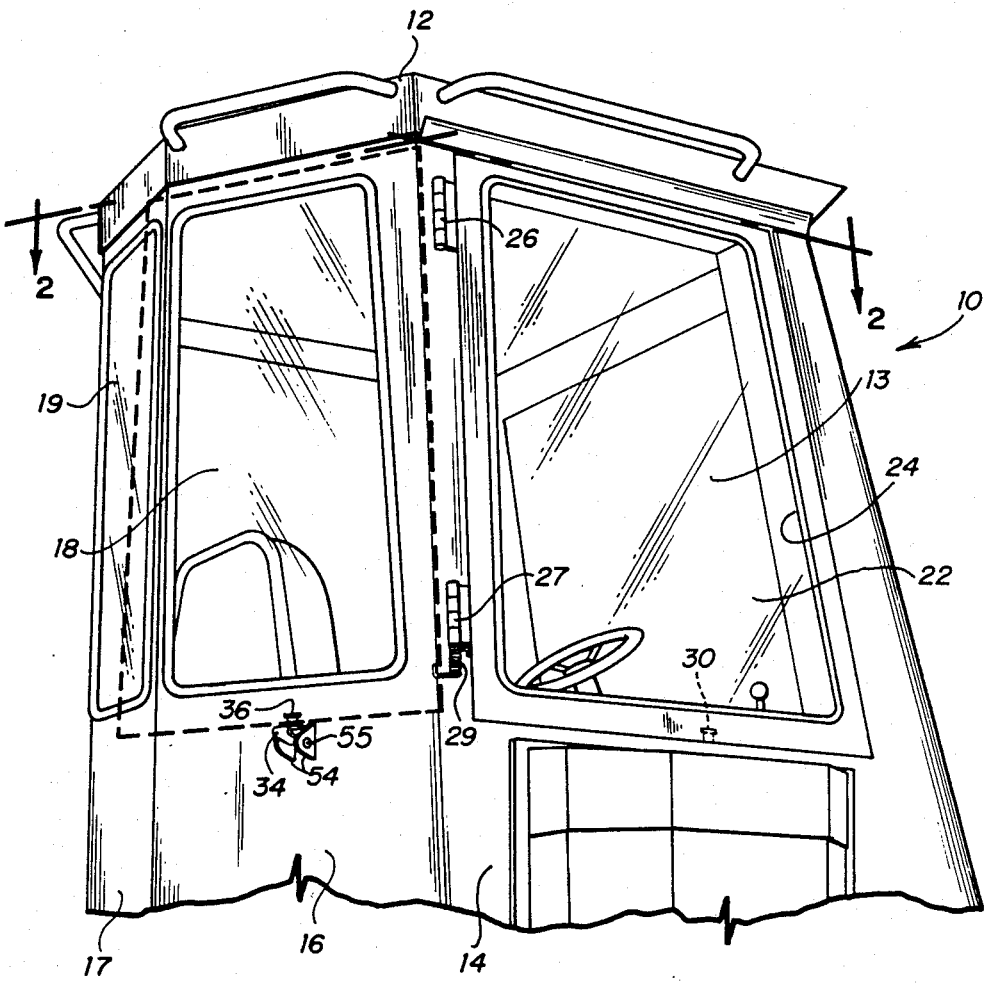

Referring to the drawing and to FIG. 1 in particular, shown therein and generally designated by the reference character 10 is a cab of a construction equipment vehicle. The cab 10 includes a top 12 a front bulkhead including a windshield 13, a side bulkhead 14 and rear bulkheads 16 and 17. The rear bulkheads 16 and 17 include windows 18 and 19. A window 22, which is also glass paneled is located in an opening 24 in the side bulkhead 14.

Figure 3:
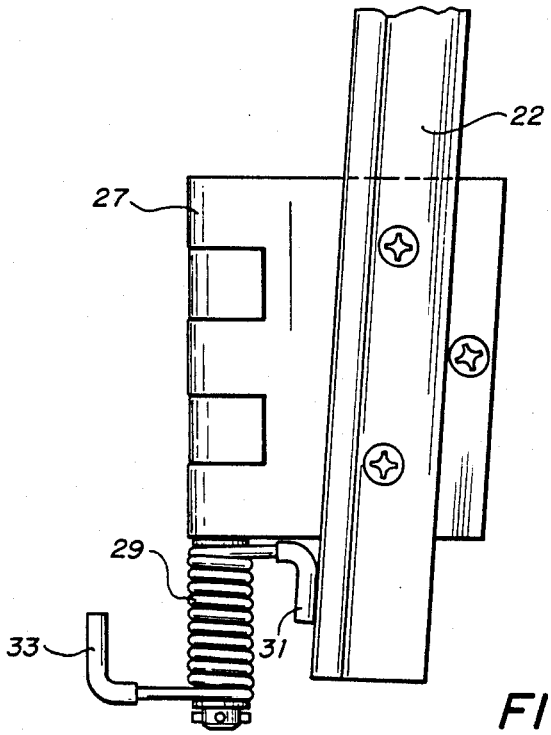
FIG. 3 is an enlarged view of a spring-loaded hinge suitable for use on a closure member constructed in accordance with the invention.

The window 22 is illustrated as being pivoted about a hinge 26 and a spring-loaded hinge 27 from a closed or covered position to an open or uncovered position shown in dash lines FIG. 1. In broad terms, the window 22 may be considered as a closure member that may be pivoted to cover and uncover the opening 24 which extends through the side bulkhead 14. The spring-loaded hinge 27 shown in detail in FIG. 3, includes a coilspring 29 biasing the window 22 toward the closed position due to the engagement of spring ends 31 and 33 with the window 22 and the rear bulkhead 16, respectively.

Figure 2:
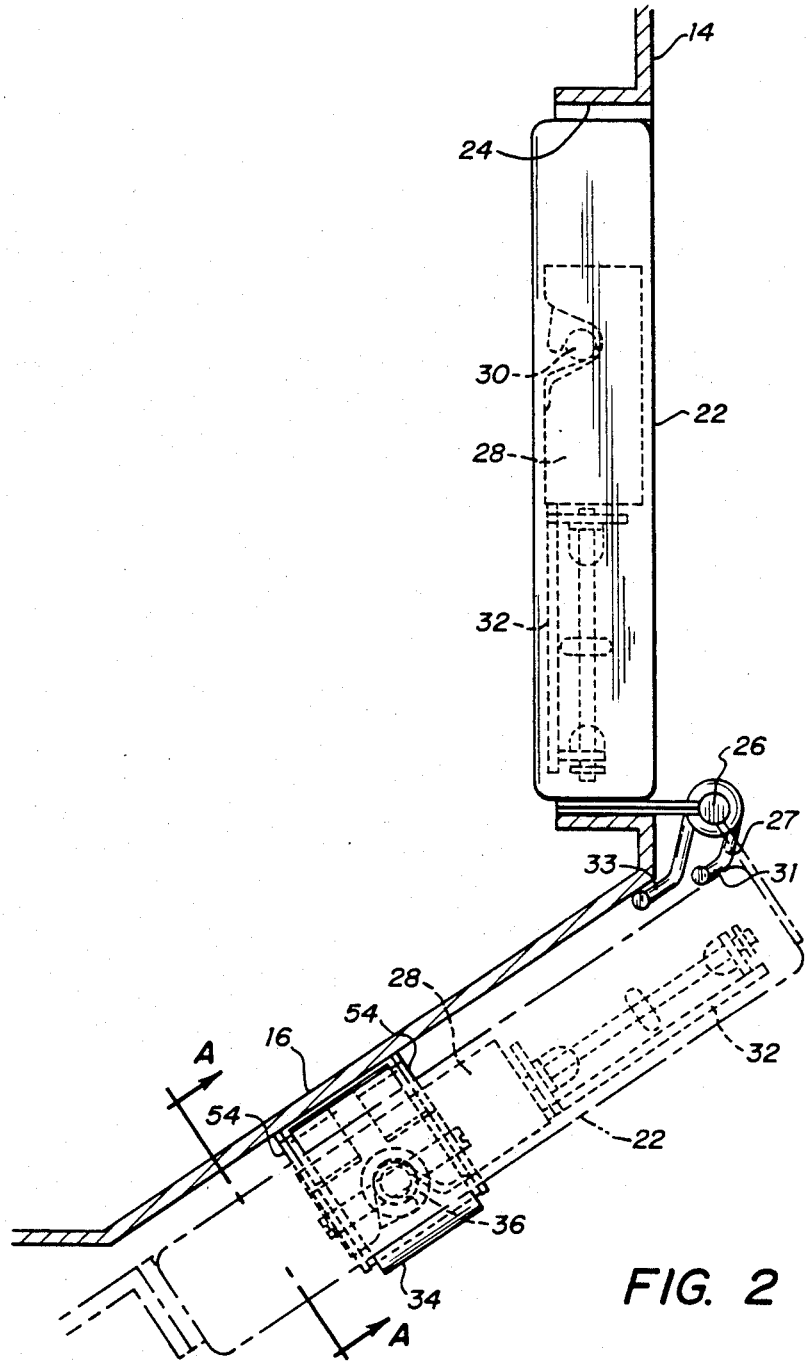
FIG. 2 is an enlarged view showing a latch assembly that is constructed in accordance with the invention mounted on a closure member.

FIG. 2 is an enlarged view taken generally along the line 2—2 of FIG. 1 illustrating the operation of the window 22. As mentioned in connection with FIG. 1, the window 22 is located in an opening 24 that extends through the side bulkhead 14. The hinges 26 and 27 are connected to the window 22 and to the bulkhead 14 so that the window 22 can pivot thereabout covering and uncovering the opening 24.

As illustrated in the solid lines in FIG. 2, the window 22 is positioned so that it covers the opening 24. In the phantom or dash line illustration of FIG. 2, the window 22 is illustrated as being pivoted to a position against the rear bulkhead 16 of the cab and thereby into to a position uncovering the opening 24.

Mounted within the frame of the window 22 is a latch 28 which will be discussed in more detail hereinafter in connection with FIG. 4. The latch 28 is in holding or latching engagement with a striker pin 30 that is mounted on the side bulkhead 14 of the vehicle in the opening 24. A latch release mechanism 32 is provided in the window 22 which operates in conjunction with the latch 28 to release the latch from the striker pin 30 and thus permit the window 22 to pivot to the open position.

When in the open position, as shown in phantom lines in FIG. 2, the window frame comes into engagement with a latch bar 34 which carries a second striker pin 36 to retain the window 22 in the open position. The arrangement of the latch bar 34 and the second striker 36 will be discussed more fully in connection with the description of FIGS. 4 through 7.

Figure 4:
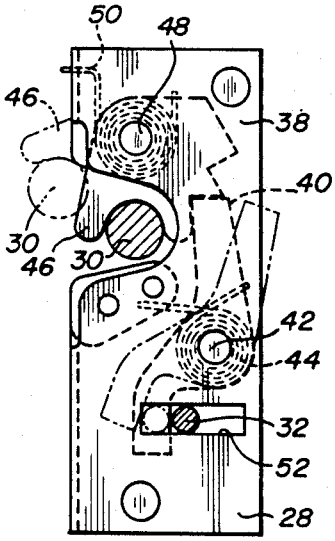
FIG. 4 is an enlarged view of a typical latch that may be utilized in the latch assembly of FIG. 2.

FIG. 4 is an enlarged view of the latch assembly 28 broken out of the window 22 to more clearly show its structure and operation. Generally, the latch 28 includes a housing 38 which carries a latch toggle 40 on a pivot pin 42. A spring 44 encircles the pivot pin 42 and engages the toggle 40 to urge the toggle 40 in a counter-clockwise direction.

Also mounted in the housing 38 is a striker pin receiver 46 which pivots about a second pivot pin 48. A second coil spring 50 encircles the pin 48 and engages the receiver 46 to urge the receiver 46 in a clockwise position as the illustrated by dash lines. To be able to release the latch 28, a slot 52 in the housing 38 receives a portion of the latch release 32.

When the latch 28 is connected to the striker pin 30 as shown in solid lines in FIG. 4, the latch 28 and thus, the window 22 can not be moved relative to the striker pin. To release the striker pin, the latch release 32 is actuated moving the toggle 40 in a clockwise direction out of engagement with the receiver 46. Upon movement to the clockwise position of the toggle 40, the spring 50 drives the receiver 46 in the clockwise direction permitting the relative movement of the striker pin 30 to the left as seen in FIG. 4.

The latch 28 remains in this position until the latch 28 is moved into engagement with the striker pin 30, as shown in dash lines in FIG. 4, which causes the receiver 46 to pivot in a counter-clockwise direction racheting against the toggle 40 until the latch 28 and striker pin 30 return to the solid line position illustrated.

While the latch 28 is described in detail so that the operation of the latch assembly of the invention can be more fully understood, the latch 28 is a purchased item and there are various arrangements thereof which may deviate from the latch described.

From the foregoing, it will be easily understood how the window 22 is retained in the closed or covered position as illustrated in solid lines in FIG. 2. It will also be understood that the latch release 32 can be reached from the inside of the cab 10 thus providing the operator with a convenient means for opening or for unlatching the window 22 to swing it to the open position. It should also be pointed out that the latch release 32 is located adjacent to the hinged end of the window 22, that is, near the hinges 26 and 27. When the window 22 is in the open position as illustrated in dash lines in FIG. 2, the latch release 32 will be within easy reach of the operator through the window opening 24.

An additional problem that is encountered when it is desired to provide for the secure latching of a closure member both in the open and closed positions is the necessity for providing some means for securely connecting the closure member in each position. Most often a latch is provided for holding the window closed and a separate latch is provided for holding it open. An arrangement of this type is not always convenient to the operator, in fact, it is frequently necessary for the operator to leave the vehicle to latch the windows in the open position and to unlatch them when it is desired to close them. Further, such an arrangement is expensive and requires greater maintenance to assure that the double latching system remains in operating condition.

In this invention, the same latch mechanism 28 is utilized to hold the window 22 both in the open and closed positions.

Figure 5:
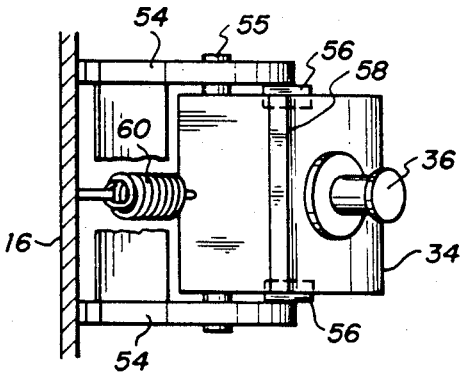
FIG. 5 is an enlarged plan view of the latch bar and striker pin remote mounted on the rear bulkhead.

As shown in FIGS. 1 and 5 the latch bar 34 is pivotally connected to the rear bulkhead 16 by brackets 54 and pivot pin 55. As can be seen in FIGS. 5–8, stop members 56 are located on the brackets 54 and are engageable with the latch bar 34 to limit the clockwise rotation of the latch bar to the maximum rotation position shown in FIG. 6.

The latch bar 34 includes a frame engaging portion 58 and carries the second striker member 36 thereon. The latch bar 34 is attached to a tension spring 60 which has its opposite end attached to the bulkhead 16. The arrangement is such that the spring 60 biases the latch bar 34 toward the position illustrated in FIG. 6.

Figure 6:
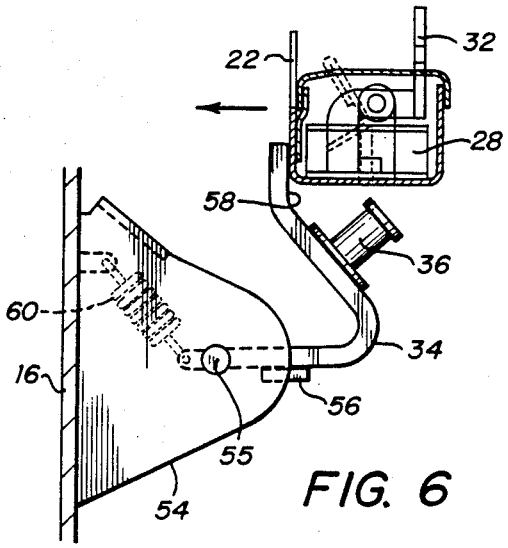
FIG. 6, 7 and 8 are views, partly in elevation and partly in cross section, taken generally along a line A—A of FIG. 2 and showing the latch assembly constructed in accordance with the invention in a series of operating positions.
Figure 7:
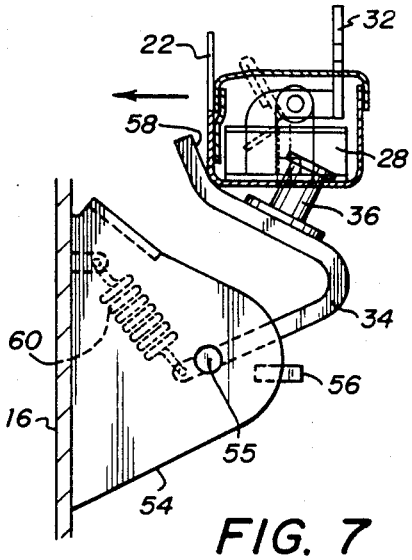
Figure 8:
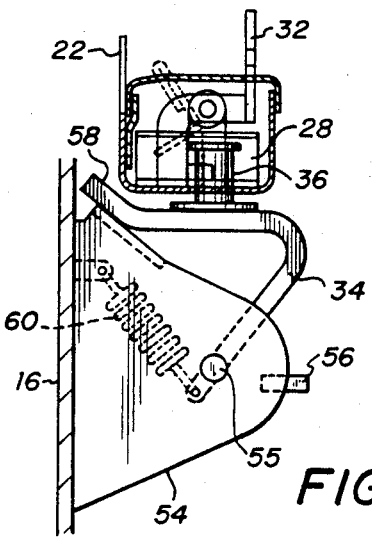

FIGS. 6, 7 and 8 illustrate the operation of the latch mechanism to retain the window 22 in the open or uncovered position.

When it is desired to open the window 22 and latch it in the open position, the window 22 is swung about the hinge or pivot 26 toward the position illustrated in dash lines in FIG. 2. As the window 22 approaches the latch bar 34 as shown in FIG. 6, the window frame engages the frame engaging portion 58 of the latch bar 34. Additional pivotal movement of the window 22 toward the rear of the cab 16, pivots the latch bar 34 into the position illustrated in FIG. 7. It can be seen in FIG. 7 that the striker pin/ 36 has started to enter the latch 28 in the window 22.

Farther pivotal movement of the window 22 toward the bulkhead 16, pivots the latch bar 34 into the position illustrated in FIG. 8 with the striker pin 36 moving fully within the latch 28. When in this position, the window 22 is in the position as shown in dash lines in FIG. 2 and is securely retained against the bulkhead 16 in the open or uncovered position.

When it is desired to close the window 22, the operator moves the latch release 32, moving the toggle 40 out of engagement with the receiver 46 and thereby permitting the receiver 46 to pivot about pin 48. When pivoted, the receiver 46 will be in the unlatched or dash-line position shown in FIG. 4. Upon releasing the latch, the window 22 can be pivoted by the operator to the closed position shown in solid lines in FIG. 2.

As the window 22 is closed, the spring 60 pivots the latch bar 34 about the pin 55 moving the second striker pin 36 out of the latch 28. The latch bar 34 pivots until it engages stops 56. In this position, the latch assembly is ready to receive the window 22 for retention against the rear bulkhead 16.

From the foregoing detailed description, it will be appreciated that the improved latch assembly of this invention provides a single latch mechanism which can be utilized to latch the closure member both in the position covering the opening and uncovering the opening, provides access to the release mechanism that is convenient to the operator, and provides a latch arrangement that is extremely simple, efficient in operation and virtually maintenance free.

It will be understood that a single embodiment of the invention has been described hereinbefore and that many changes and modifications can be made thereto without departing from the spirit or scope of the invention.

What is claimed is:

1. A latch assembly for releaseably retaining a pivotal closure member, such as a window or the like, in positions covering and uncovering an opening extending through a bulkhead, comprising in combination:

a jaw-type latch mounted in the closure member;

latch releasing means mounted in the closure member and accessible from one side thereof for releasing the latch;

a striker member mounted on said bulkhead for latchably engaging said latch when said closure member is in the covered position; and striker means mounted on said bulkhead remote from said opening for latchably engaging said latch when said closure member is in the uncovered position, said striker means including a second striker member pivotal into latching engagement with said latch when engaged by said latch during movement of said closure member to the uncovering position.

2. A latch assembly for releaseably retaining a pivotal closure member, such as a window or the like, in positions covering and uncovering an opening extending through a bulkhead, comprising in combination:

a jaw-type latch mounted in the closure member;

latch releasing means mounted in the closure member and accessible from one side thereof for releasing the latch;

a striker member mounted on said bulkhead for latchably engaging said latch when said closure member is in the covered position; and striker means mounted on said bulkhead remote from said opening for latchably engaging said latch when said closure member is in the uncovered position, said striker means including a latch bar pivotally mounted on said bulkhead, said latch bar having a closure member engaging portion, and a second striker member mounted on and pivotal with said latch bar into latching engagement with said latch when said closure member engages said engaging portion during movement of said closure member to the uncovering position.

3. The latch assembly of claim 2 and also including resilient means connected to the bulkhead and to said latch bar for biasing said latch bar toward a position wherein said engaging portion can engage said closure member.

4. The latch assembly of claim 3 and also including a stop member operably mounted on bulkhead for engaging said latch bar to limit the pivotal movement of said engaging portion relatively away from said bulkhead.

5. The latch assembly of claim 4 wherein said resilient means includes a tension spring.

6. Improved latch striker means for releasably retaining a closure member the closure member being mounted on a bulkhead for pivotal movement between positions, covering and uncovering an opening extending through the bulkhead and having a frame and a releasable jaw-type latch located in the frame to engage a first striker member mounted on the bulkhead to latch the closure member in the covered position and having release means connected with the latch for releasing the latch from the striker located on one side of the closure member, the improved latch striker means comprising:

a latch bar member pivotally located on the bulkhead and including a closure member engaging portion; and, a second striker member mounted on the latch bar member for pivotal movement into latching engagement with the latch in the closure member when the closure member frame engages the frame engaging portion of the latch bar member during movement of the closure member to the uncovered position, thereby securing the closure member in the uncovered position utilizing the latch in the closure member.

7. The improved latch striker means of claim 6 and also including resilient means connected to the bulkhead and to said latch bar for biasing said latch bar toward a position wherein said engaging portion can engage said closure member.

8. The improved latch striker means of claim 7 and also including a stop member operably mounted on said bulkhead for engaging said latch bar to limit the pivotal movement of said engaging portion relatively away from said bulkhead.

9. The improved latch striker means of claim 8 wherein said resilient means includes a tension spring.

* * * * *